US007121886B1

(12) United States Patent
Liu

(10) Patent No.: US 7,121,886 B1
(45) Date of Patent: Oct. 17, 2006

(54) ELECTRICAL CONNECTOR

(75) Inventor: Lu-Ta Liu, Taipei (TW)

(73) Assignee: Lankom Electronics Co., Ltd. (TW)

( * ) Notice: Subject to any disclaimer, the term of this patent is extended or adjusted under 35 U.S.C. 154(b) by 0 days.

(21) Appl. No.: 11/168,763

(22) Filed: Jun. 29, 2005

(51) Int. Cl.
*H01R 13/648* (2006.01)

(52) U.S. Cl. ..... 439/607

(58) Field of Classification Search ..... 439/607, 439/608, 609, 610
See application file for complete search history.

(56) References Cited

U.S. PATENT DOCUMENTS 6,926,557 B1 * 8/2005 Yamaguchi et al. ..... 439/607
2005/0009401 A1 * 1/2005 Hu et al. ..... 439/607
2005/0106939 A1 * 5/2005 Zhang et al. ..... 439/607
2005/0221673 A1 * 10/2005 Myer et al. ..... 439/607

* cited by examiner

*Primary Examiner*—Tulsidas C. Patel
*Assistant Examiner*—Phuongchi Nguyen
(74) *Attorney, Agent, or Firm*—Hershkovitz & Associates; Abe Hershkovitz

(57) ABSTRACT

An electric conductor has a body, a circuit board attached to one side of the body, a housing with a cover mounted over the body. An electrical conductor has a first end electrically connected to a ground node of the circuit board, and has a first end extending through the body and electrically contacted with the cover, whereby the housing together with the cover forms a ground shell for the connector.

5 Claims, 4 Drawing Sheets

ELECTRICAL CONNECTOR

BACKGROUND OF THE INVENTION

1. Field of the Invention

The present invention relates to a connector, and particularly relates to a connector with a ground pin to electrically contact with a metal housing and a circuit board of the connector.

2. Description of Related Art

The transmission line is normally used to convey electronic information, and a connector is needed to attach the transmission line to the computer or electronic products.

The connecter normally has a housing and a main body therein. The main body has a first end and a second end; the first end has a socket and a circuit board is mounted in the second end. The circuit board has a terminal group extended to the socket. Multiple pins are mounted at the bottom of the circuit board and extended out of the housing.

The connector is welded to the circuit board or the electronic product and an additional grounding structure is mounted in the connector. One end of the transmission line is inserted to the plug jack and the other end of the transmission line is inserted to another connector, whereby the electric information is conveyed through the transmission line.

However, additional cost is required for the grounding structure, which is not favorable nor economical for the manufacturers.

Therefore, the invention provides a grounding connector to mitigate or obviate the aforementioned problem.

SUMMARY OF THE INVENTION

The main objective of the present invention is to provide a grounding connector that has an electric conductor, a cover and a plurality of springs contacting with the electric conductor, whereby a circuit loop is formed which is a grounding structure itself. Therefore, it is no need to prepare an additional grounding structure for the connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
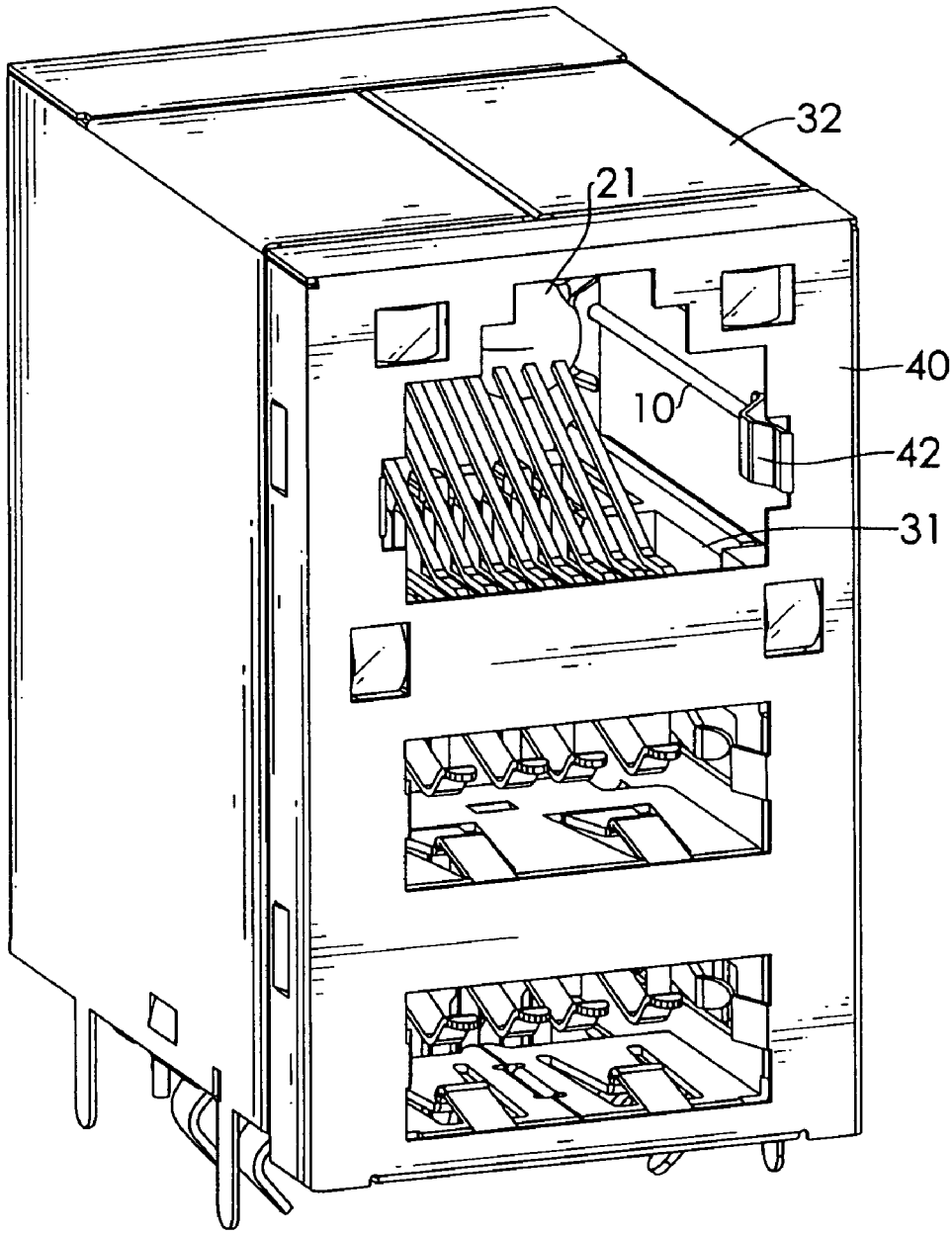
FIG. 1 is a perspective view of the connector in accordance with this invention.
Figure 2:
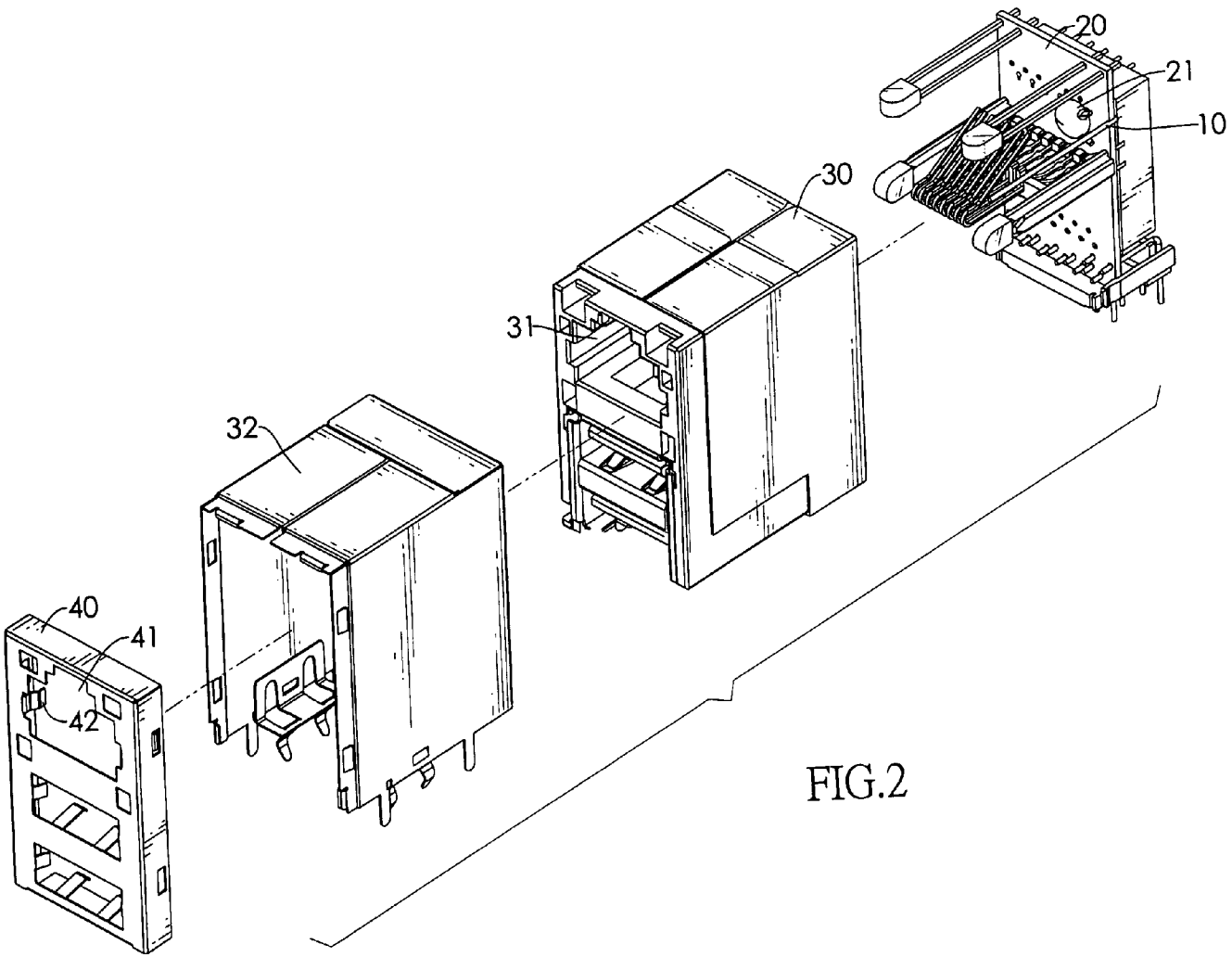
FIG. 2 is an exploded view of the connector in accordance with this invention.

With reference to FIG. 1 and FIG. 2, a connector (10) in accordance with the present invention comprises a circuit board (20), a body (30) and a housing (32) with a cover (40). However, the cover (40) and the housing (32) can be formed integrally, rather than two individual components as shown. A pin-shaped electric conductor (10) has a first end and a second end, wherein the first end is attached to an edge of the circuit board (20) and electrically connected to a ground node of the circuit board (20). A capacitor (21) is mounted on the circuit board (20), wherein the capacitor (21) has a terminal also connected to the ground node. Therefore, the electric conductor (10) can also connected to the grounded terminal of the capacitor (21). The circuit board (20) is attached to one side of the body (30).

The second end of the electric conductor (10) is inserted to a socket (31) defined in the body (30). The body (30) can be defined with different types of sockets such as the RJ45 socket or USB sockets. The electric conductor (10) is in electrical contact with an inner wall of the socket (31). The electric conductor (10) is a metal pin in this embodiment, which can also be a terminal of the capacitor (21) or other electrically conductive rod.

The cover (40) has an opening (41) defined therein. The opening (41) corresponds to the socket (31), and resilient pieces such as leaf springs (42) are formed at the edge of the opening (41).

Figure 3:
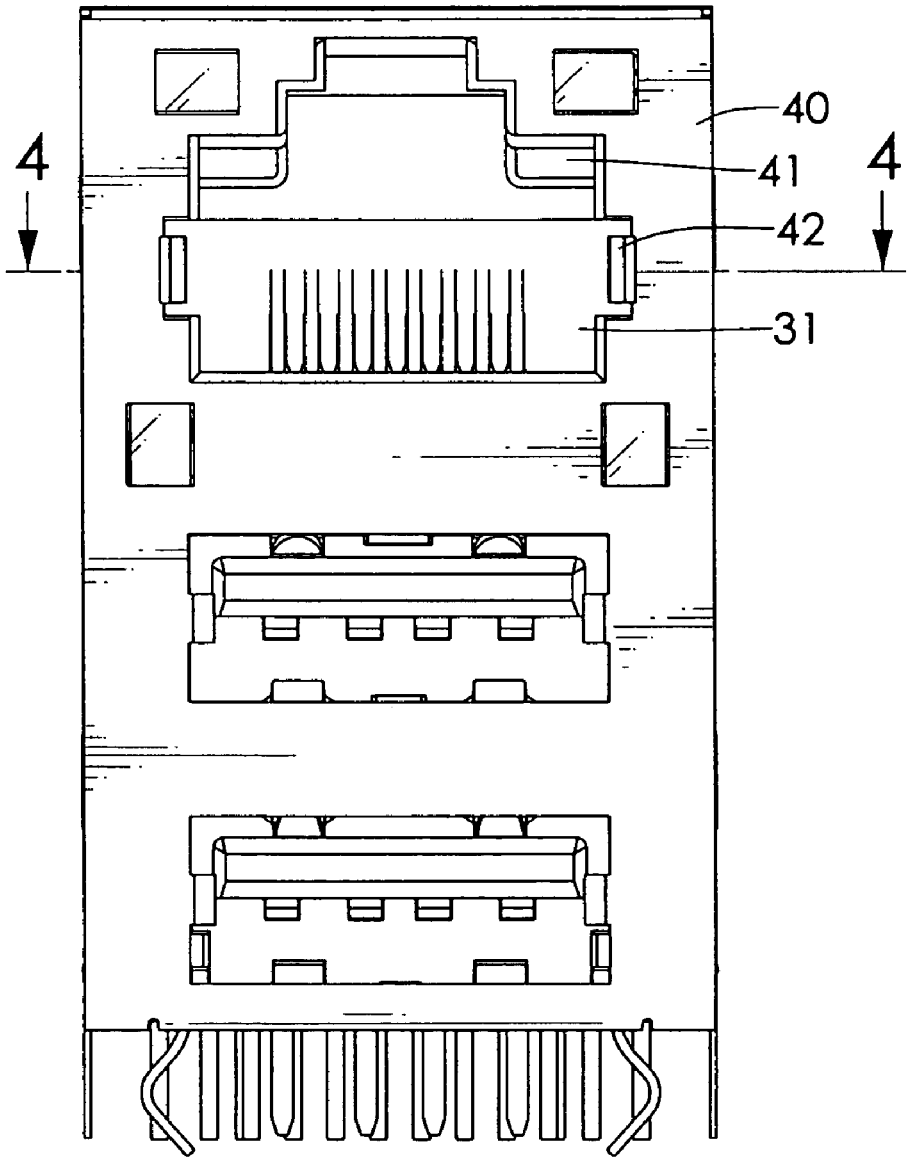
FIG. 3 is a plan view of the connector in accordance with this invention.
Figure 4:
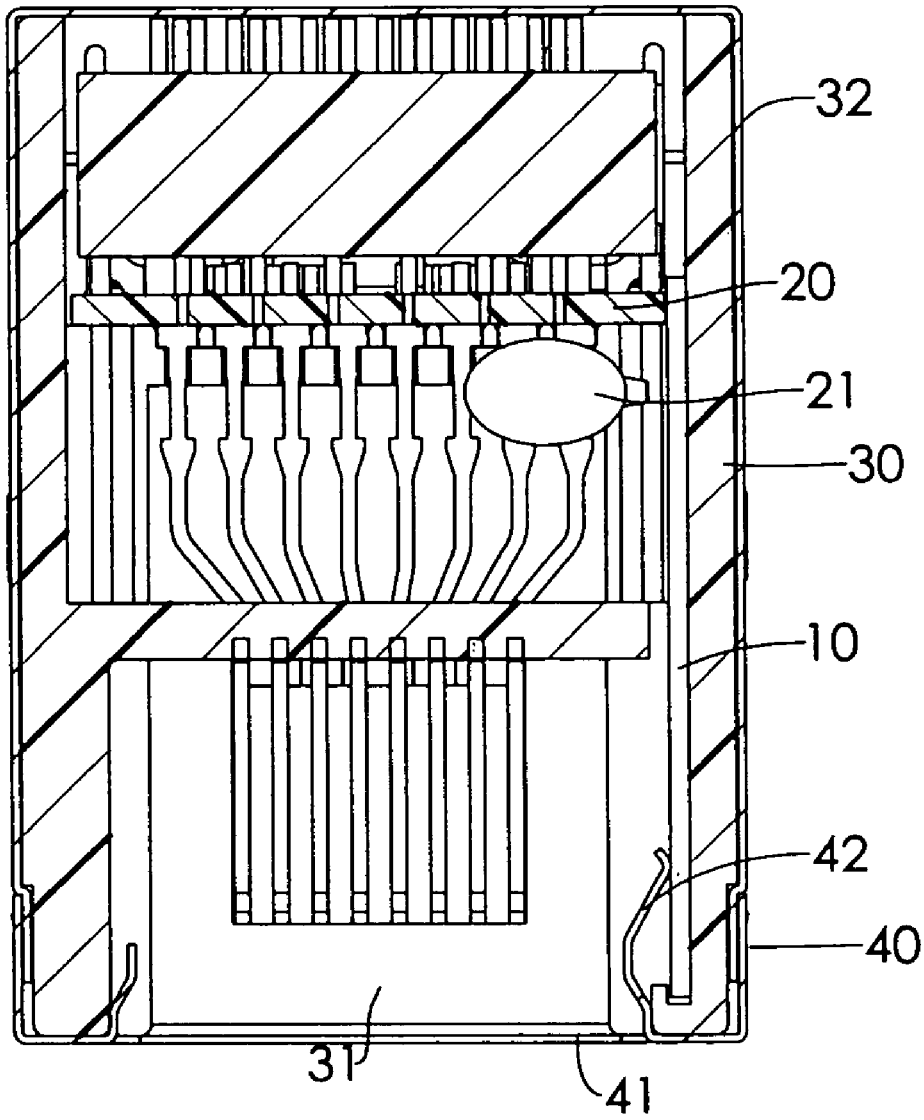
FIG. 4 is a sectional view of the connector along line 4—4 in FIG. 3.

With reference to FIG. 3 and FIG. 4, the body (30) is received in the housing (32) and confined by the cover (40). The leaf springs (42) extend into the socket (31) and contact with the electric conductor (10).

When the connector is electrically mounted on a circuit board (not shown) such as a motherboard of an electrical device, at least one ground terminal extending from the circuit board (20) is connected to a ground node of the motherboard. Therefore, the electric conductor (10) has the ground function. Since the electric conductor (10) is contacted with the cover (40), the entire cover (40) as well as the housing (32) forms a ground shell for the connector to avoid electronic jamming.

In addition, if the electric conductor (10) is electrically connected to the capacitor (21), the cover (40) together with the housing (32) still serve as a ground shell for the connector. Besides, the electric conductor (10) can also be connected to a pulse transformer or a filter on the circuit board (20), which can further ensure the appropriate transmission of the electric information.

As the electric conductor (10) mounted on the circuit board (30) is biased by the leaf springs (42) to contact with the cover (40), the entire shell of the connector can easily achieve the ground function. In this way, there is no need to mount an additional grounding structure, and the production cost is reduced relative to the prior art. Further, It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector comprising:

a body with a side defined with at least one socket;

a circuit board attached to the side of the body;

a housing with a cover mounted over the body, wherein the cover has an opening corresponding to the at least one socket and having an edge, and at least one leaf spring is formed at the edge of the opening; and an electric conductor biased by the leaf spring to contact the cover, extending through the body and having a first end attached to a ground node of the circuit board; and a second end.

2. The connector as claimed in claim 1, wherein a capacitor is mounted on the circuit board and has a terminal connected to the ground node of the circuit board; and the electric conductor is a conductive pin and is connected to the terminal of the capacitor.

3. The connector as claimed in claim 1, wherein a capacitor is mounted on the circuit board and has a terminal connected to the ground node of the circuit board, wherein the electric conductor is connected to the terminal of the capacitor.

4. The connector as claimed in claim 1, wherein the electric conductor is a conductive pin.

5. The connector as claimed in claim 4, wherein a capacitor is mounted on the circuit board and has a terminal connected to the ground node of the circuit board, wherein the electric conductor is connected to the terminal of the capacitor.

* * * * *